US008292665B2

(12) United States Patent
D'Amico et al.

(10) Patent No.: US 8,292,665 B2
(45) Date of Patent: Oct. 23, 2012

(54) POWER SUPPLY CONNECTOR

(75) Inventors: Sebastiano D'Amico, Vicenza (IT); Andrea Fongaro, Altavilla Vicentina (IT)

(73) Assignee: Sumuto S.R.L., Vicenza (IT)

( * ) Notice: Subject to any disclaimer, the term of this patent is extended or adjusted under 35 U.S.C. 154(b) by 0 days.

(21) Appl. No.: 12/736,099

(22) PCT Filed: Mar. 9, 2009

(86) PCT No.: PCT/EP2009/001659
§ 371 (c)(1),
(2), (4) Date: Sep. 9, 2010

(87) PCT Pub. No.: WO2009/112218
PCT Pub. Date: Sep. 17, 2009

(65) Prior Publication Data

US 2011/0003510 A1 Jan. 6, 2011

(30) Foreign Application Priority Data

Mar. 12, 2008 (IT) ..... VI2008A0063

(51) Int. Cl.
*H01R 13/66* (2006.01)

(52) U.S. Cl. ..... 439/620.09; 430/620.14

(58) Field of Classification Search ..... 439/620.09, 439/620.14
See application file for complete search history.

(56) References Cited

U.S. PATENT DOCUMENTS

| | | | | |
|---|---|---|---|---|
| 4,407,552 | A * | 10/1983 | Watanabe et al. | 439/607.12 |
| 4,580,866 | A * | 4/1986 | Hagner | 439/620.09 |
| 4,679,013 | A * | 7/1987 | Farrar et al. | 333/182 |
| 4,761,147 | A * | 8/1988 | Gauthier | 439/607.01 |
| 5,152,699 | A * | 10/1992 | Pfeifer | 439/620.16 |
| 5,164,873 | A * | 11/1992 | Krantz et al. | 361/56 |
| 6,328,579 | B1 | 12/2001 | Mori et al. | |
| 2006/0178035 | A1 * | 8/2006 | Shimirak | 439/404 |
| 2007/0134985 | A1 * | 6/2007 | Frysz et al. | 439/620.09 |

FOREIGN PATENT DOCUMENTS

| | | |
|---|---|---|
| DE | 295 12 985 | 10/1995 |
| GB | 2 274 926 A | 6/1994 |

* cited by examiner

*Primary Examiner* — Hien Vu
(74) *Attorney, Agent, or Firm* — R. Neil Sudol; Coleman Sudol Sapone P.C.

(57) ABSTRACT

A power supply connector (1), comprising an insulating body (2) which supports a plurality of electrical contacts (3) and a plurality of wiring conductors (4), and comprising an electrical filtering means (5), which is interposed between the electrical contacts and the wiring conductors and is integrally inserted in the insulating body.

6 Claims, 4 Drawing Sheets

POWER SUPPLY CONNECTOR

BACKGROUND OF THE INVENTION

The present invention relates to a power supply connector particularly suitable for electric motors.

As is known, in order to supply power to electric motors, and particularly to submersed motors, hermetic connectors are commonly used which are composed of two portions that can be mated mechanically, one shaped like a plug and the other one shaped like a socket, which connect in a protected manner the electrical contacts of the motor to the power supply line derived from the mains.

Generally, this type of connector offers only an electrical insulation between the outside environment and the conductors that are live, without applying any action to the power supply line.

However, in order to avoid radio interference and overvoltages, filters constituted by simple electronic circuits arranged at the windings and provided in practice by means of varistors, gas-filled diodes or other electronic components, are usually inserted in the power supply circuit of electric motors.

The fitting and wiring of these filters is generally performed by specialized personnel, which must install them by repeating a series of operations which, in addition to considerably affecting production times, may lead to errors in the connections, with consequent malfunction of the motors.

OBJECTS OF THE INVENTION

The aim of the invention is to solve the problems described above, providing a power supply connector that allows to reduce production times and at the same time allows to avoid any errors during the installation of filters for radio interference and overvoltages.

Within the scope of this aim, a particular object of the invention is to provide a power supply connector that is compliant with applicable safety standards.

A further object of the invention is to provide a power supply connector that is simple to provide and can be manufactured at competitive costs.

SUMMARY OF THE INVENTION

This aim, these objects and others that will become better apparent hereinafter are achieved by a power supply connector, which includes an insulating body which supports a plurality of electrical contacts and a plurality of wiring conductors, characterized in that it includes an electrical filtering means, which is interposed between the electrical contacts and the wiring conductors, the electrical filtering means being integrally inserted in the insulating body.

BRIEF DESCRIPTION OF THE DRAWINGS

Further characteristics and advantages will become better apparent from the description of preferred but not exclusive embodiments of a power supply connector according to the invention, illustrated by way of non-limiting example in the accompanying drawings, wherein.

DETAILED DESCRIPTION

Figure 1:
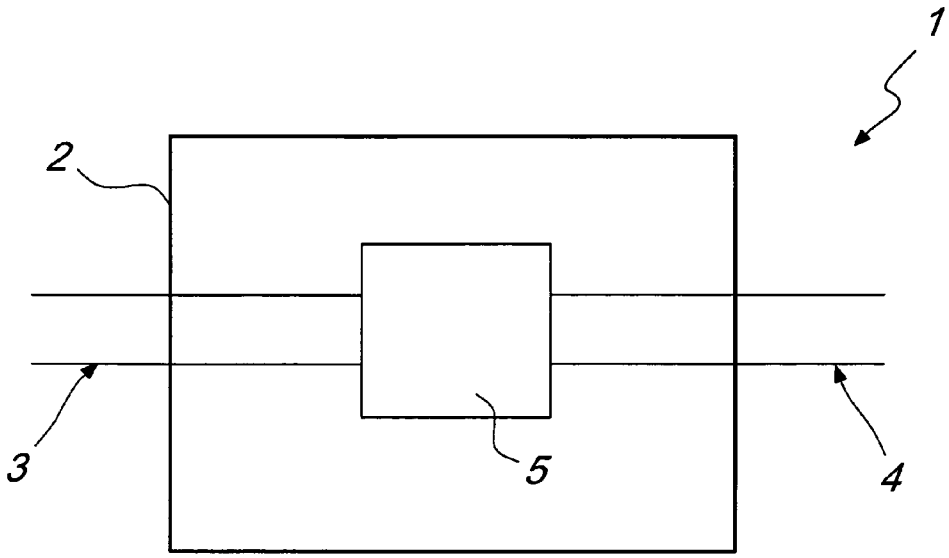
FIG. 1 is a schematic view of a power supply connector according to the invention.
Figure 2:
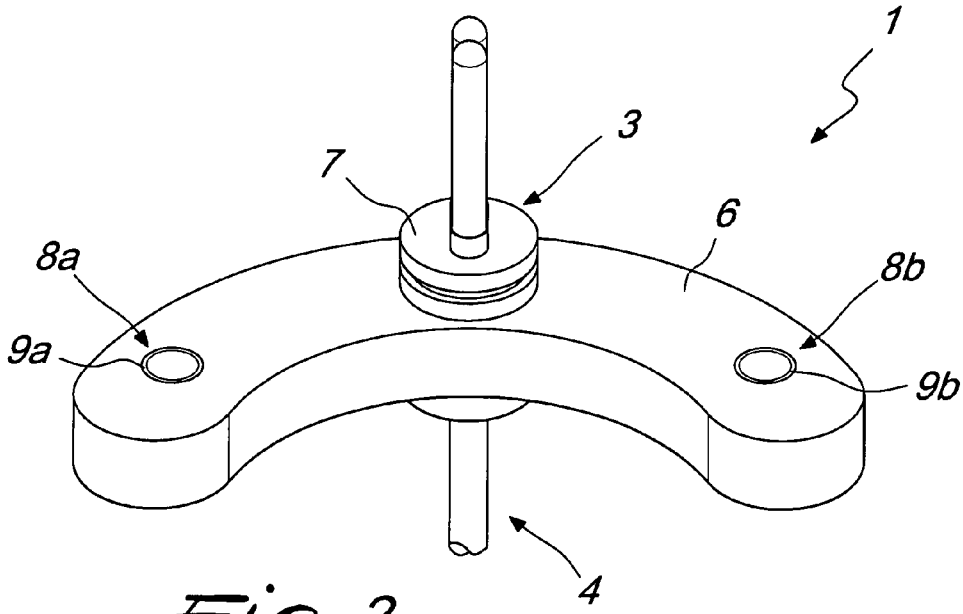
FIG. 2 is a perspective view of a power supply connector according to the invention.
Figure 3:
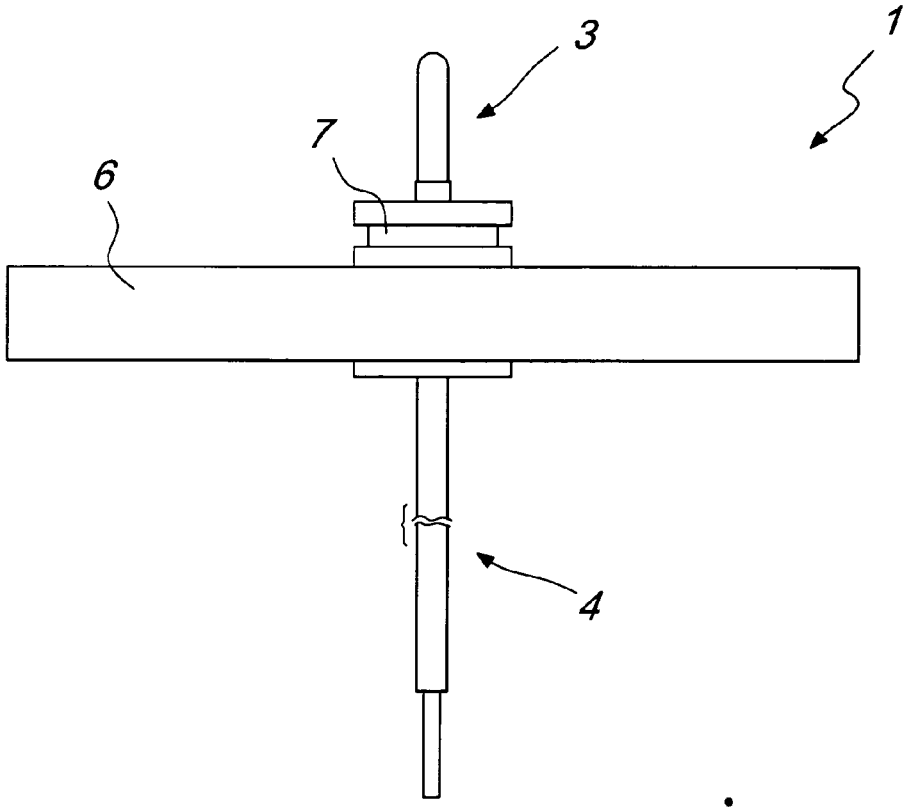
FIG. 3 is a front view of a power supply connector according to the invention.
Figure 4:
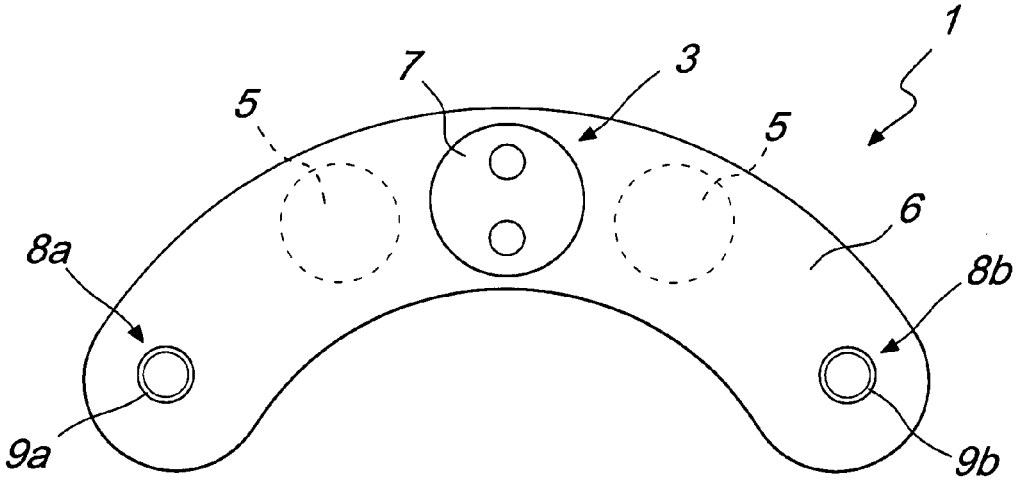
FIG. 4 is a top view of a power supply connector according to the invention.
Figure 5:
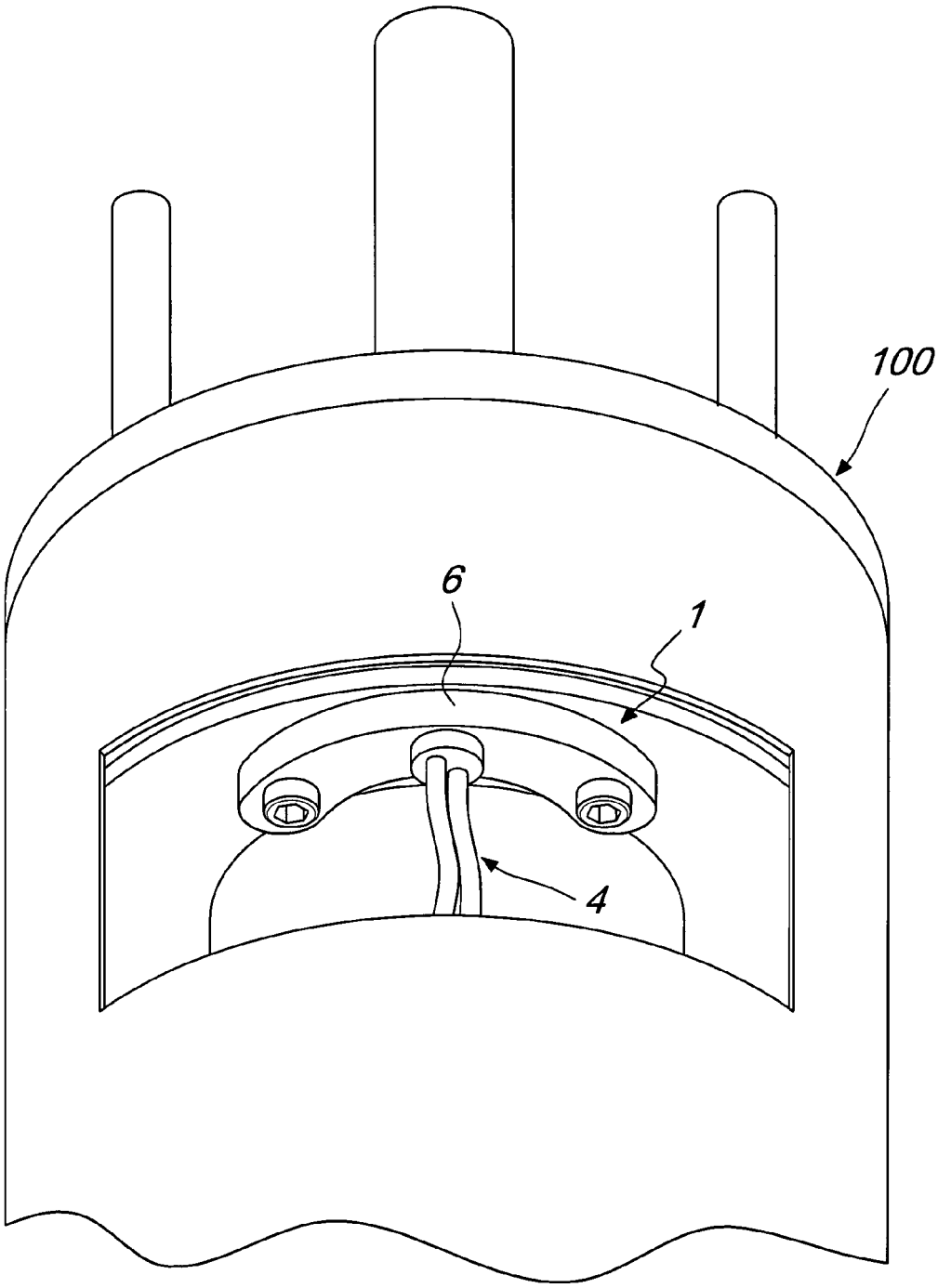
FIG. 5 is a perspective view of a power supply connector according to the invention, applied to an electric motor.

With reference to the cited FIGS. 1 to 5, the power supply connector, generally designated by the reference numeral 1, comprises an insulating body 2, which is made of synthetic material having particular characteristics from an electrical standpoint and from a mechanical standpoint. More specifically, the insulating body 2 is formed monolithically by molding electrically insulating, heat-resistant and resilient synthetic material, in order to increase its resistance to high temperatures and to any mechanical stress.

The insulating body 2 supports a pair of electrical contacts 3, which are adapted meant to connect the power supply connector 1 to a power supply line that is derived from the electrical distribution mains, and a pair of wiring conductors 4, which are adapted to supply power to an electric motor 100, which in the present case is constituted by a submersed motor.

Both the electrical contacts 2 and the wiring conductors 4 can vary in number and in configuration as well according to the specific requirements.

According to the invention, the power supply connector 1 comprises an electrical filtering means 5, which is constituted by a plurality of varistors, a plurality of gas-filled diodes or other suitable electronic components which are interposed between the electrical contacts 3 and the wiring conductors 4 to which they are connected. The electrical filtering means 5 is integrally inserted in the insulating body 2, which encloses it and protects it, in addition to making its assembly easy and quick.

The insulating body 2 comprises an arc-like member 6 on which a mechanical connecting member 7 is monolithically defined, which partially protects the electrical contacts 3 and facilitates mechanical coupling to an optional complementarily shaped plug that is electrically connected to the power supply line. Arc-like member 6 has an upper major face (at 6 in FIG. 2 and in the plane of the paper in FIG. 4) and a lower major face opposed thereto. Arc-like member 6 further has a convex arcuate surface along one side of each of the major faces (at the upper side in FIG. 4) and a concave arcuate surface along an opposite side of each of the major faces (at the lower side in FIG. 4) so that the arc-like member 6 is substantially in the form of a circular sector.

The arc-like member 6 is provided with two fixing holes 8*a* and 8*b*, which are formed at its opposite ends in order to allow to detachably anchor the power supply connector 1 to a support.

Two ground conductors 9*a* and 9*b* are coaxially associated with the fixing holes 8*a* and 8*b*, and by making contact with the metal frame of the electric motor 100 constitute a constant reference potential for the electrical circuit.

Figure 6:
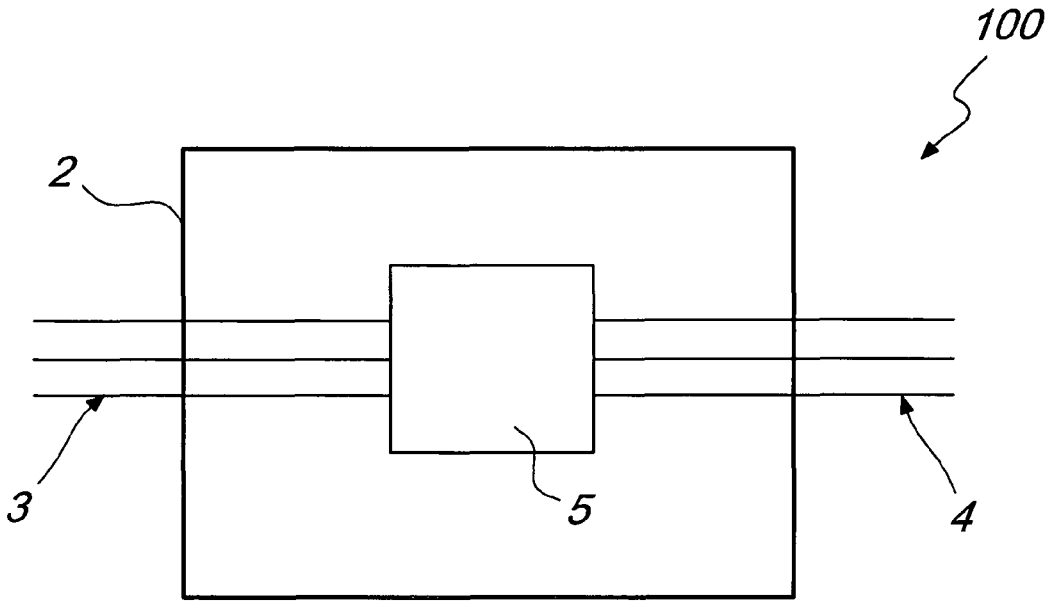
FIG. 6 is a schematic view of a further embodiment of a power supply connector according to the invention.
Figure 7:
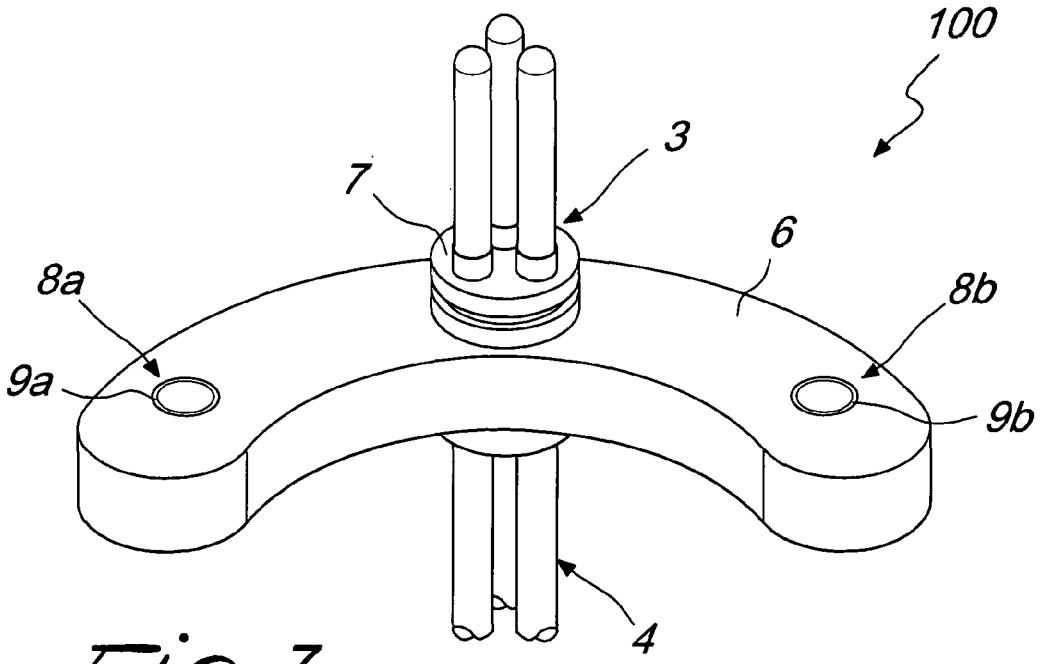
FIG. 7 is a perspective view of the power supply connector of the preceding figure.

In a further embodiment of the power supply connector according to the invention that is particularly suitable for supplying single-phase three-wire motors, shown in the accompanying FIGS. 6 and 7, in which it is generally designated by the reference numeral 100, there are three electrical contacts 2 and three wiring conductors 4.

In the embodiment shown in FIGS. 6 and 7, the elements corresponding to the elements that have already been described with reference to the embodiment shown in FIGS. 1 to 5, have been designated by the same reference numerals.

The use of the power supply connector according to the invention is evident from what has been described and illustrated, and in particular it is evident that it is sufficient to connect the wiring conductors 4 to the power supply conductors of the electric motor 100 and subsequently detachably anchor the insulating body 2 to the motor by means of the fixing holes 8*a* and 8*b*.

As a consequence of this fact, the ground conductors 9*a* and 9*b* make contact with the metallic frame of the electric motor 100, connecting it to the ground.

In this manner, the connection of the power supply connector 1 is appropriately completed both to supply electric power to the electric motor 100 and to avoid radio interference and overvoltages, by means of the filtering performed by the electric filtering means 5.

In practice it has been found that the power supply connector according to the invention fully achieves the intended aim, since it allows to reduce processing times, avoiding any errors during the installation of the filters for radio interference and overvoltages.

Moreover, the power supply connector according to the invention, in addition to being compliant with the applicable safety provisions, is simple to provide and can be manufactured at competitive costs.

The power supply connector thus conceived is susceptible of numerous modifications and variations, all of which are within the scope of the inventive concept; all the details may furthermore be replaced with other technically equivalent elements.

In practice, the materials used, so long as they are compatible with the specific use, as well as the contingent shapes and dimensions, may be any according to the requirements and the state of the art.

This application claims the priority of Italian Patent Application No. VI2008A000063 filed on Mar. 12, 2008, the subject matter of which is incorporated herein by reference.

The invention claimed is:

1. A power supply connector, comprising an insulating body which supports a plurality of electrical contacts and a plurality of wiring conductors; and an electrical filtering means interposed between said electrical contacts and said wiring conductors, said electrical filtering means being integrally inserted in said insulating body, said insulating body comprising an arc-like member having two planar major faces, a convex arcuate surface along one side of each of said major faces and a concave arcuate surface along an opposite side of each of said major faces so that said arc-like member is substantially in the form of a circular sector, said arc-like member being formed monolithically so as to configure the connector for a submersible under water power supply, said arc-like member internally accommodating said electrical filtering means; wherein said insulating body includes a mechanical connecting member that attaches to the electrical contacts.

2. The power supply connector according to claim 1, wherein said arc-like member comprises at least one fixing hole that is formed at one end of said arc-like member, for a detachable anchoring of said electrical connector to a support.

3. The power supply connector according to claim 1, wherein said insulating body is formed monolithically with said arc-like member, said mechanical connecting member at least partially protecting said electrical contacts.

4. The power supply connector according to claim 1, wherein said insulating body is made of electrically insulating synthetic material.

5. The power supply connector according to claim 1, wherein said insulating body is made of heat-resistant synthetic material.

6. The power supply connector according to claim 1, wherein said insulating body is made of resilient synthetic material.

* * * * *

UNITED STATES PATENT AND TRADEMARK OFFICE

CERTIFICATE OF CORRECTION

PATENT NO. : 8,292,665 B2
APPLICATION NO. : 12/736099
DATED : October 23, 2012
INVENTOR(S) : Sebastiano D'Amico and Andrea Fongaro It is certified that error appears in the above-identified patent and that said Letters Patent is hereby corrected as shown below:

Title Page, Item (73), change the name of Assignee from "Sumuto S.R.L." to --Sumoto S.R.L.--

Signed and Sealed this
First Day of January, 2013

David J. Kappos

David J. Kappos
*Director of the United States Patent and Trademark Office*